US005079645A

United States Patent [19]

Ritter

[11] Patent Number: 5,079,645

[45] Date of Patent: Jan. 7, 1992

[54] SOLAR POWERED DIFFRACTOR

[76] Inventor: Carl A. Ritter, 9205 Church, Grosse Isle, Mich. 48138

[21] Appl. No.: 727,313

[22] Filed: Jul. 9, 1991

Related U.S. Application Data

[63] Continuation-in-part of Ser. No. 579,726, Oct. 11, 1990, abandoned.

[51] Int. Cl.[5] ..... F21V 5/02

[52] U.S. Cl. ..... 359/615; 248/131; 362/806

[58] Field of Search ..... 350/167, 168; 362/340, 362/809, 811, 806; 248/131

[56] References Cited

U.S. PATENT DOCUMENTS

| | | | |
|---|---|---|---|
| 1,440,518 | 1/1923 | Wood | 362/811 |
| 3,531,636 | 9/1970 | Birch | 362/811 |
| 3,610,918 | 10/1971 | Barlow | 362/811 |
| 4,102,121 | 7/1978 | Veazey | 362/809 |
| 4,250,537 | 2/1981 | Roegner et al. | 362/811 |

*Primary Examiner*—Bruce Y. Arnold
*Assistant Examiner*—Martin Lerner
*Attorney, Agent, or Firm*—Peter D. Keefe

[57] ABSTRACT

A solar powered ornamental light pattern producing device which produces visually pleasing patterns of light, composed of a housing, a pair of photo-voltaic devices connected with the housing, a shaft rotatably connected with the housing and rotated by the photo-voltaic devices, a pedestal connected with a distal end of the shaft, a flat mirror located on the pedestal, and a multi-faceted crystal which is located upon the flat mirror. When sunlight strikes the solar cells of the photo-voltaic devices a mechanical linkage with the photo-voltaic devices causes the shaft to rotate. As the shaft rotates, the various facets of the crystal are rotated, causing sunlight reflected off the mirror and interacting with the crystal, and sunlight directly interacting with the crystal, to be refracted and reflected into a whole host of pleasing patterns and colors.

5 Claims, 1 Drawing Sheet

SOLAR POWERED DIFFRACTOR

CROSS-REFERENCE TO RELATED APPLICATIONS

The present application is a continuation-in-part of my co-pending application, Ser. No. 07/579,726, filed on Oct. 11, 1990, and now abpndoned upon the filing of the present application.

BACKGROUND OF THE INVENTION

1. Field of the Invention

The present invention relates to novelty lighting devices, and particularly to an ornamental device which utilizes solar power to produce pleasing light patterns.

2. Description of the Prior Art

Among the most pleasing and entertaining visual effects are those produced by ornamental light pattern producing devices. In lounges, it is common to see a rotating multi-faceted mirrored ball reflecting light from a lamp into a myriad of all patterns all over the room. A lamp with rotating three-colored circular filter is used to pleasingly illuminate Christmas trees. And there are special effects light devices used in night clubs and theatre halls. While these devices produce beautiful light patterns, they are frequently very expensive and require standard electric utility power to operate them.

Accordingly, what is needed in the art is an inexpensive ornamental light pattern producing device which produces a pleasing visual effect and which does not require standard electric utilities to operate.

SUMMARY OF THE INVENTION

The present invention is a solar powered ornamental light pattern producing device which produces visually pleasing patterns of light.

The present invention is composed of a housing, a pair of photo-voltaic devices connected with the housing, a shaft connected with the housing and rotating by the photo-voltaic devices, a pedestal connected with a distal end of the shaft, a flat mirror located on the pedestal, and a multi-faceted crystal which is located upon the flat mirror.

In operation, when sunlight strikes the solar cells of the photo-voltaic devices a mechanical linkage with the photo-voltaic causes the shaft to rotate. As the shaft rotates, the various facets of the crystal are rotated, causing sunlight reflected off the mirror and interacting with the crystal, and sunlight directly interacting with the crystal, to be refracted and reflected into a whole host of pleasing patterns and colors.

Accordingly, it is an object of the present invention to produce a solar powered ornamental light pattern producing device which produces a pleasing visual effect.

It is a further object of the present invention to provide a pleasant, colorful light display that is inexpensive, long lasting and silent in operation that is mainly intended for home use.

These, and additional objects, advantages, features and benefits of the present invention will become apparent from the following specification.

DETAILED DESCRIPTION OF THE PREFERRED EMBODIMENT

Figure 1:
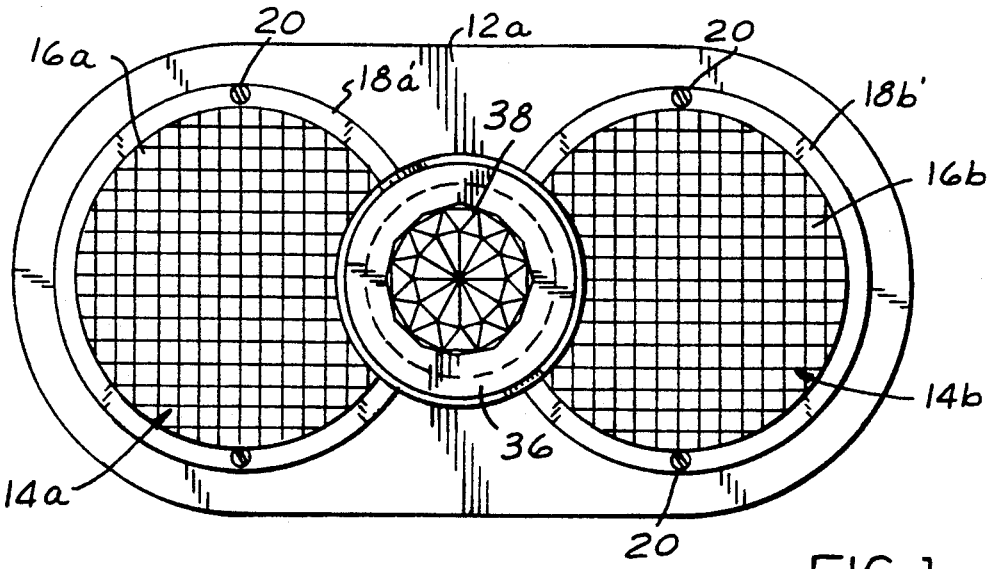
FIG. 1 is a plan view of the solar powered ornamental light pattern producing device according to the present invention.
Figure 2:
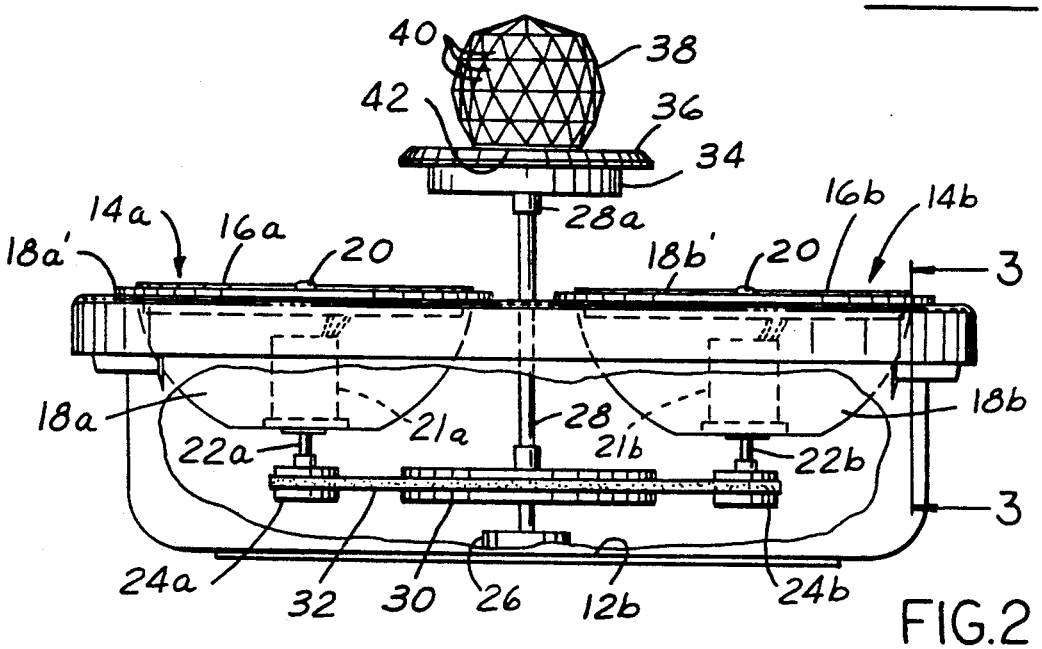
FIG. 2 is a partly sectional side view of the solar powered ornamental light pattern producing device according to the present invention.
Figure 3:
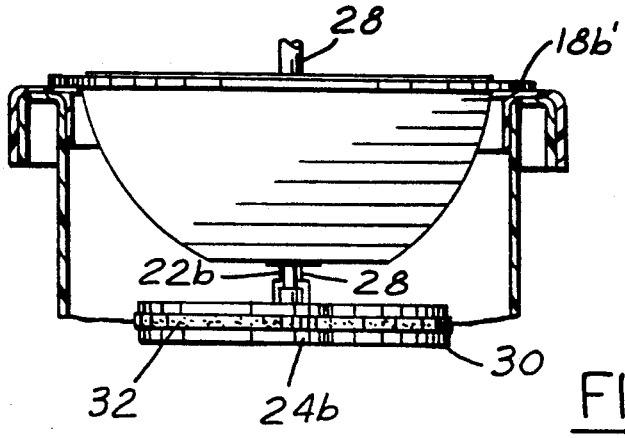
FIG. 3 is a partly sectional end view of the solar powered ornamental light pattern producing device, seen along lines 3—3 in FIG.2.

Referring now to the Drawings, FIGS. 1 through 3 generally show the preferred embodiment of the solar powered ornamental light pattern producing device 10 according to the present invention.

A housing 12, preferably constructed of a plastic material, supports two photo-voltaic devices 14*a*, 14*b*. The photo-voltaic devices each include a solar cell 16*a*, 16*b* which is located on the housing so as to be externally exposed. It is preferred for the solar cells to be located at the top 12*a* of the housing 12. Each of the photo-voltaic devices 14*a*, 14*b* futher includes a casing 18*a*, 18*b*. Each casing includes a lip 18*a'*, 18*b'* which interfaces with the top 12*a* of the housing 12. Screws 20, or any other suitable fastener,are used to fixedly secure the photo-voltaic devices 14*a*, 14*b* to the housing 12.

Within each photo-voltaic device 14*a*, 14*b* is an electric motor 21*a*, 21*b* having a drive-shaft 22*a*, 22*b*. Electrical connections within each casing provides electrical power to the respective motor from its respective solar cell when the solar cells are energized by an external source, particularly sunlight. At the end of each drive-shaft 22*a*, 22*b* is a driving sheave 24*a*, 24*b*. An example of a suitable photo-voltaic device 14*a*, 14*b* is that manufactured by solar Electric Engineering Company of Rohnert Park, Calif., Part No. ST105, and distrubuted by Solar World of Colorado Springs, Colo., which operates at a nominal 3 volts when adequate light shines upon its solar cells.

Connected to the housing 12 at a central location of the interior bottom 12*b* thereof, is bearing 26. Emanating perpendicularly from the bottom 12*b* is a shaft 28 rotatably mounted to the bearing 26. In line with each of the driving sheaves 24*a*, 24*b* is a driven sheave 30. A belt 32 rotatably interconnects each of the driving sheaves 24*a*, 24*b* with the sheave 30. Thusly, when the motors spin, the driven sheave necessarily spins. The relative cross-section of the driving sheaves as compared to that of the driven sheave and the speed of rotation of the motors determines the desired rotation rate of the shaft 28 under normal light conditions.

The shaft 28 extends upwardly through an opening in the top 12*a* of the housing 12, and continues perpendicularly from the top a distance above the top. A pedestal 34 is connected to the distal end 28*a* of the shaft 28. Located atop the pedestal 34 is a mirror 36, preferably flat, having the reflective side facing upwardly. Located atop the mirror 36 is a multi-faceted crystal 38. The crystal 38 is constructed of a light transmissive material, such as glass or quartz, and is preferred to be clear. The crystal 38 is further preferred to have a general spherical shape having an exterior surface composed of a large number of flat facets 40 and flat base 42. The crystal 38 is selected so as to be capable of capturing light incident thereupon and refracting and reflecting this light into a vast number of patterns.

In operation, light (preferably sunlight) incident upon the solar cells causes the motors to spin, which in turn causes the shaft and its associated crystal, to spin. The crystal refracts and reflects the light incident thereupon from both reflected light off the mirror and direct light falling thereupon into a pleasing and variating pattern of moving, flashing colors (of the solar spectrum) as the crystal spins.

It is preferred for the solar powered ornamental light pattern producing device to be dimensioned so that it may be placed upon a window sill.

To those skilled in the art to which this inventions appertains, the above described preferred embodiment may be subject to change or modification. For instance, while solar light is preferred for operation, any other suitable light source, such as fluorescent light, is permissible. Further, while it is preferred that two photo-voltaic units be utilized, it is possible to operate with only one or more than two. Still further, while it is preferred for the solar cells to be mounted so as to be externally exposed with respect to the housing, it is sufficient that they be mounted so as to be exposed to light incident upon the housing; for example, within the housing under a clear portion of the housing. Such change or modification can be carried out without departing from the scope of the invention, which is intended to be limited only by the scope of the appended claims.

What is claimed is:

1. A light powered ornamental light pattern producing device comprising:

a housing having a top;

at least one photo-voltaic device connected with said housing, said at least one photo-voltaic device comprising:

a casing;

a solar cell connected to said casing, said solar being mounted with respect to said housing so as to be exposed to light incident on said housing;

an electric motor electrically connected with said solar cell, said electric motor having drive shaft; and a driving sheave connected with said drive shaft; a shaft rotatably connected with respect to said housing, said shaft having a distal end extending perpendicularly from said top of said housing, said shaft having a driven sheave connected thereto in line with said driving sheave;

bearing means for rotatably connecting said shaft to said housing;

belt means for mechanically linking said driving sheave and said driven sheave;

a pedestal located at said distal end of said shaft;

a mirror located on said pedestal, said mirror having a reflective surface; and a multi-faceted crystal located on said reflective surface of said mirror;

wherein light striking said solar cell of said at least one photo-voltaic device results in said motor of said at least one photo-voltaic device spinning, thereby spinning said shaft, and thereby spinning said crystal as to produce a pleasant and pleasing light display as light reflected off said reflective surface of said mirror strikes said crystal and is thereupon refracted and reflected by said crystal and futher as light directly strikes said crystal and is thereupon refracted and reflected by said crystal.

2. The light powered ornamental light pattern producing device of claim 1, wherein said crystal is substantially shaped, said crystal having an exterior surface characterized by a large number of flat faces.

3. A light powered ornamental light pattern producing device comprising:

a housing having a top;

a first photo-voltaic device connected with said housing, said first photo-voltaic device comprising:

a first casing;

a first solar cell connected to said first casing, said first solar cell being mounted with respect to said housing so as to be exposed to light incident on said housing;

a first electric motor electrically connected with said first solar cell, said first electric motor having a first drive shaft; and a first driving sheave connected with said first drive shaft; a second photo-voltaic device connected with said housing, said second photo-voltaic device comprising:

a second casing;

a second solar cell connected to said second casing, said second solar cell being mounted with respect to said housing so as to be exposed to light incident on said housing;

a second electric motor electrically connected with said second solar cell, said second electric motor having a second drive shaft; and a second driving sheave connected with said second drive shaft;

a shaft rotatably connected with respect to said housing, said shaft having a distal end extending perpendicularly from said top of said housing, said shaft having a driven sheave connected thereto in line with said first and second driving sheaves;

bearing means for rotatably connecting said shaft to said housing;

belt means for mechanically linking said first driving sheave, said second driving sheave and said driven sheave;

a pedestal located at said distal end of said shaft;

a mirror located on said pedestal, said mirror having a reflective surface; and a multi-faceted crystal located on said reflective surface of said mirror;

wherein light striking said first and second solar cells results in said first and second motors spinning, thereby spinning said shaft, thereby spinning said crystal so as to produce a pleasant and pleasing light display as light reflected off said reflective surface of said mirror strikes said crystal and is thereupon refracted and reflected by said crystal and futher as light directly strikes said crystal and is thereupon refracted by said crystal.

4. The light powered ornamental light pattern producing device of claim 3, wherein said crystal is substantially spherically shaped, said crystal having an exterior surface characterized by a large number of flat facets.

5. The light powered ornamental light pattern producing device of claim 4, wherein said first and second photo-voltaic devices are symmetrically located with respect to said housing and said shaft, and said shaft is located substantially at a central position with respect to said housing.

* * * * *